US011613799B2

(12) United States Patent
Itagaki et al.

(10) Patent No.: US 11,613,799 B2
(45) Date of Patent: Mar. 28, 2023

(54) FE-BASED AMORPHOUS ALLOY RIBBON FOR FE-BASED NANOCRYSTALLINE ALLOY, AND METHOD FOR MANUFACTURING THE SAME

(71) Applicant: HITACHI METALS, LTD., Tokyo (JP)

(72) Inventors: Hajime Itagaki, Tokyo (JP); Motoki Ohta, Tokyo (JP)

(73) Assignee: HITACHI METALS, LTD., Tokyo (JP)

( * ) Notice: Subject to any disclaimer, the term of this patent is extended or adjusted under 35 U.S.C. 154(b) by 220 days.

(21) Appl. No.: 16/497,325

(22) PCT Filed: Mar. 28, 2018

(86) PCT No.: PCT/JP2018/013023
§ 371 (c)(1),
(2) Date: Sep. 24, 2019

(87) PCT Pub. No.: WO2018/181604
PCT Pub. Date: Oct. 4, 2018

(65) Prior Publication Data

US 2020/0377981 A1 Dec. 3, 2020

Related U.S. Application Data

(60) Provisional application No. 62/479,330, filed on Mar. 31, 2017.

(51) Int. Cl.
*C22C 45/02* (2006.01)
*C22C 45/00* (2023.01)
(Continued)

(52) U.S. Cl.
CPC ..... *C22C 45/008* (2013.01); *B24B 29/005* (2013.01); *C21D 7/02* (2013.01); *C22C 1/11* (2023.01)

(58) Field of Classification Search
None
See application file for complete search history.

(56) References Cited

U.S. PATENT DOCUMENTS 5,765,625 A 6/1998 Yukumoto et al.
7,012,527 B2 3/2006 Sunakawa et al.
(Continued)

FOREIGN PATENT DOCUMENTS

CN 1199202 C 4/2005
JP S61209755 A 9/1986
(Continued)

OTHER PUBLICATIONS

English translation of JP 2000/054089-A (originally published Feb. 22, 2000) obtained from J-Plat Pat.*
(Continued)

*Primary Examiner* — George Wyszomierski
(74) *Attorney, Agent, or Firm* — Westman, Champlin & Koehler, P.A.

(57) ABSTRACT

One embodiment of the present invention provides an Fe-based amorphous alloy ribbon for an Fe-based nanocrystalline alloy, the Fe-based amorphous alloy ribbon being a cooled body of a molten metal that has been applied to a surface of a chill roll, wherein the Fe-based amorphous alloy ribbon includes a recess having a depth of 1 μm or more in a 0.647 mm×0.647 mm region located in a central part, in the ribbon width direction, of a ribbon surface, which is a cooled surface, in which a maximum area of the recess having a depth of 1 μm or more is 3000 $\mu m^2$ or less; and a method of manufacturing the same.

15 Claims, 4 Drawing Sheets

(51) Int. Cl.

| | |
|---|---|
| ***B24B 29/00*** | (2006.01) |
| ***C21D 7/02*** | (2006.01) |
| ***C22C 1/11*** | (2023.01) |

(56) References Cited

U.S. PATENT DOCUMENTS

| | | | | |
|---|---|---|---|---|
| 10,468,182 | B2 | 11/2019 | Yoshizawa et al. | |
| 2002/0053372 | A1* | 5/2002 | Arai | B22F 9/08 148/300 |
| 2003/0041931 | A1 | 3/2003 | Sunakawa et al. | |
| 2004/0036607 | A1 | 2/2004 | Sunakawa et al. | |
| 2004/0245491 | A1 | 12/2004 | Arai et al. | |
| 2012/0154084 | A1* | 6/2012 | Yoshizawa | H01F 41/0226 335/297 |
| 2013/0314198 | A1 | 11/2013 | Yoshizawa et al. | |
| 2016/0035474 | A1* | 2/2016 | Azuma | H01F 3/04 336/213 |
| 2016/0168674 | A1 | 6/2016 | Seiji et al. | |
| 2017/0178805 | A1 | 6/2017 | Yoshizawa et al. | |
| 2018/0369902 | A1 | 12/2018 | Sunakawa | |
| 2021/0301380 | A1* | 9/2021 | Nakahata | B32B 37/12 |

FOREIGN PATENT DOCUMENTS

| | | | |
|---|---|---|---|
| JP | H08-019834 | A | 1/1996 |
| JP | 2000/054089 | A * | 2/2000 |
| JP | 2002-316243 | A | 10/2002 |
| JP | 2003-275851 | A | 9/2003 |
| JP | 3494371 | B2 | 2/2004 |
| JP | 3594123 | B2 | 11/2004 |
| JP | 2008279457 | A | 11/2008 |
| JP | 4244123 | B2 | 3/2009 |
| JP | 4529106 | B2 | 8/2010 |
| JP | 2016-211067 | A | 12/2016 |
| WO | 2012102379 | A1 | 8/2012 |
| WO | 2017090402 | A1 | 6/2017 |

OTHER PUBLICATIONS

English translation of JP 61-209755 (originally published Sep. 18, 1986) from J-Plat Pat.*

Chinese Office Action for corresponding Chinese Patent Application No. 201880022019.2, dated Aug. 28, 2020; partial English translation.

International Search Report and dated Jun. 5, 2018 for corresponding International Application No. PCT/JP2018/013023, filed Mar. 28, 2018.

Written Opinion of the International Searching Authority dated Jun. 19, 2018 for corresponding International Application No. PCT/JP2018/013023, filed Mar. 28, 2018.

Extended European Search Report dated Dec. 10, 2020 for corresponding European Patent Application No. 18775502.0, 9 pages.

* cited by examiner

FE-BASED AMORPHOUS ALLOY RIBBON FOR FE-BASED NANOCRYSTALLINE ALLOY, AND METHOD FOR MANUFACTURING THE SAME

CROSS-REFERENCE TO RELATED APPLICATIONS

This application is the national stage of International Application No. PCT/ JP2018/013023, filed Mar. 28, 2018, which claims the benefit of U.S. Provisional Patent Application No. 62/479,330 filed Mar. 31, 2017. Each of the above applications is hereby expressly incorporated by reference, in its entirety, into the present application.

TECHNICAL FIELD

The present disclosure relates to an Fe-based amorphous alloy ribbon for use in an Fe-based nanocrystalline alloy, and a method of manufacturing the same.

BACKGROUND ART

An iron (Fe) based amorphous alloy ribbon (Fe-based amorphous alloy thin strip) is becoming more popular as a material for an iron core of a transformer. Further, nanocrystalline soft magnetic materials have also been proposed.

As a nanocrystalline soft magnetic material, an Fe-based nanocrystalline alloy is known.

An Fe-based nanocrystalline alloy is produced by crystallizing an amorphous alloy. In the case of casting a ribbon (thin strip) of an amorphous alloy, a molten alloy is discharged onto the surface of a chill roll whose peripheral surface is made of, for example, a copper (Cu) alloy, and is rapidly solidified. Thereby, an alloy ribbon is produced. In this case, in order to stably maintain the flatness of the surface of the alloy ribbon, the peripheral surface of the chill roll is controlled to maintain a smooth surface having a surface roughness of, for example, 0.5 μm or less.

From the viewpoint of maintaining the peripheral surface of the chill roll smooth as described above, conventionally, polishing of the peripheral surface of the chill roll by using a polishing brush roll or the like is ordinary conducted.

Namely, a molten metal of an Fe-based amorphous alloy is discharged onto the surface of a chill roll, and the molten metal is rapidly solidified on the chill roll, to produce an alloy ribbon. Then, the alloy ribbon thus produced is peeled off from the chill roll. However, there is a tendency that, even after peeling, a part of the solidified alloy remains on the peripheral surface of the chill roll. The alloy left on the peripheral surface of the chill roll is likely to impair the cooling ability with respect to the molten metal of an Fe-based nanocrystalline alloy, which is discharged thereafter. That is to say, since the thermal conductivity of an amorphous alloy is generally lower than that of a Cu alloy, when a residue of an amorphous alloy is present in a convex shape on the peripheral surface, the cooling efficiency with respect to the molten metal that is newly discharged onto the peripheral surface of the chill roll is lowered. As a result, the alloy ribbon to be produced becomes brittle and, in some cases, an amorphous state cannot be maintained after cooling and solidification. Thus, there are cases in which crystallization occurs in some parts. Further, there are cases in which only an alloy ribbon, whose cooled surface is inferior in flatness, is obtained.

Accordingly, in order to continuously remove the solidified alloy that remains on the surface of the chill roll at the time of production, conventionally, after peeling off the alloy ribbon, that has been rapidly solidified, from the chill roll, the width direction of the chill roll is uniformly polished using a polishing brush roll or the like (see, for example, Patent Document 1).

Patent Document 1: Japanese Patent Application Laid-Open (JP-A) No. 2002-316243

SUMMARY OF INVENTION

Technical Problem

However, a molten metal of an Fe-based amorphous alloy for an Fe-based nanocrystalline alloy, in which the molten metal includes Fe—Si—B—Cu—Nb in the composition thereof, is easily crystallized and has low wettability with respect to a Cu alloy. Therefore, even if smoothness of the peripheral surface of the chill roll is maintained as described above, when the molten metal is discharged onto the peripheral surface of the chill roll and is rapidly solidified, a shrinkage stress is generated, and due to the shrinkage stress generated through rapid solidification, the alloy is easily peeled off (separated) from the surface of the chill roll from just after the solidification. Therefore, due to the fact that cooling becomes slow, the magnetic properties are also easily deteriorated.

Since the shrinkage stress at the time of solidification has correlation with a width of the alloy ribbon to be formed on the chill roll, the width of the alloy ribbon that can be casted stably is restricted to be, for example, from about 50 mm to about 60 mm, and even if the peripheral surface of the chill roll is uniformly polished as described above, in the case of forming a wide alloy ribbon, which is as wide as 70 mm or more, there are cases in which stable casting cannot be conducted.

The present disclosure is made in consideration of the forgoing.

An aspect of one embodiment of the present invention is to provide an Fe-based amorphous alloy ribbon for use in an Fe-based nanocrystalline alloy, the Fe-based amorphous alloy ribbon having a wide width (preferably, a width of 70 mm or more; hereinafter, the same applies) and having excellent magnetic properties.

Further, an aspect of another embodiment of the present invention is to provide a method of manufacturing an Fe-based amorphous alloy ribbon for use in an Fe-based nanocrystalline alloy, the Fe-based amorphous alloy ribbon having a wide width and having excellent magnetic properties.

Solution to Problem

Polishing of a chill roll, which has been performed conventionally, has a purpose of removing a residual alloy on the peripheral surface of the chill roll. However, it is considered that, in the polishing which is ordinarily performed, if it is possible to suppress the peeling (separation) of the alloy ribbon accompanying the shrinkage stress which may occur at the time of rapid solidification of a molten metal, casting of an alloy ribbon having a wide width becomes possible. Specifically, the idea was arrived at that, by selecting the conditions of the polishing brush roll, it is possible to form polishing scratches, which are effective for the suppression of peeling (separation) of the alloy ribbon, on the peripheral surface of the chill roll.

Specific means for addressing the above problems include the following embodiments.

<1> An Fe-based amorphous alloy ribbon for an Fe-based nanocrystalline alloy, the Fe-based amorphous alloy ribbon being a cooled body of a molten metal that has been applied to a surface of a chill roll, wherein:

the Fe-based amorphous alloy ribbon includes a recess having a depth of 1 μm or more in a 0.647 mm×0.647 mm region located in a central part, in a ribbon width direction, of a ribbon surface, which is a cooled surface, and a maximum area of the recess having a depth of 1 μm or more is 3000 $\mu m^2$ or less.

<2> The Fe-based amorphous alloy ribbon according to <1>, wherein an area ratio of recesses having a depth of 1 μm or more and an area of 100 $\mu m^2$ or more, in the region, is 1% or more but less than 10%.

<3> The Fe-based amorphous alloy ribbon according to <2>, wherein the area ratio is 1% or more but less than 5%.

<4> The Fe-based amorphous alloy ribbon according to any one of <1> to <3>, wherein the maximum area of the recess is 2500 $\mu m^2$ or less.

<5> The Fe-based amorphous alloy ribbon according to any one of <1> to <4>, wherein 60% or more of the recesses with respect to a total number thereof satisfy the following Equation 1.

In the following Equation 1, L represents a length of the recess in a casting direction, and W represents a width of the recess in the ribbon width direction, which is orthogonal to the casting direction.

$$0.6 \leq L/W \leq 1.8 \quad \text{Equation 1}$$

<6> The Fe-based amorphous alloy ribbon according to <5>, wherein 30% or more of the recesses with respect to the total number thereof satisfy the following Equation 2.

$$0.6 \leq L/W \leq 1.2 \quad \text{Equation 2}$$

<7> The Fe-based amorphous alloy ribbon according to any one of <1> to <6>, wherein a ribbon width is from 70 mm to 250 mm.

<8> A method of manufacturing an Fe-based amorphous alloy ribbon for an Fe-based nanocrystalline alloy, the method including applying a molten metal onto a surface of a chill roll, while continuously polishing the chill roll by using a polishing brush roll that satisfies the following conditions (1) to (6):

(1) a composition of a brush bristle of the polishing brush roll contains a polyamide resin and inorganic abrasive grains for polishing;

(2) a particle diameter of the inorganic abrasive grains for polishing is in a range of from 60 μm to 90 μm;

(3) a shape of a cross section orthogonal to a longitudinal direction of the brush bristle: a round shape having a diameter of from 0.7 mm to 1.0 mm;

(4) a rotation speed of the polishing brush roll relative to the rotation speed of the chill roll is from 10 m/sec to 23 m/sec;

(5) an angle θ formed by a rotational direction of a tip of the brush bristle and a rotational direction of the chill roll: from 5° to 30°; and (6) a pressure in applying the molten metal (discharge pressure of the molten metal) is from 20 kPa to 30 kPa.

<9> The method of manufacturing an Fe-based amorphous alloy ribbon according to <8>, wherein the polishing brush roll further satisfies the following conditions (7) and (8).

(7) a roll diameter of the polishing brush roll is from 120 mm to 300 mm; and (8) a density of brush bristles at the brush bristle tip is from 0.2 bristles/$mm^2$ to 0.45 bristles/$mm^2$.

<10> The method of manufacturing an Fe-based amorphous alloy ribbon according to <8> or <9>, wherein the polyamide resin is nylon.

<11> The method of manufacturing an Fe-based amorphous alloy ribbon according to any one of <8> to <10>, wherein a ratio of the content of the inorganic abrasive grains for polishing to the content of the polyamide resin is from 10/90 to 40/60, based on mass.

Advantageous Effects of Invention

According to one embodiment of the present invention, an Fe-based amorphous alloy ribbon for use in an Fe-based nanocrystalline alloy, the Fe-based amorphous alloy ribbon having a wide width (preferably, a width of 70 mm or more) and having excellent magnetic properties, may be provided.

Further, according to another embodiment of the present invention, a method of manufacturing an Fe-based amorphous alloy ribbon for use in an Fe-based nanocrystalline alloy, the Fe-based amorphous alloy ribbon having a wide width and having excellent magnetic properties, may be provided.

DESCRIPTION OF EMBODIMENTS

Figure 1:
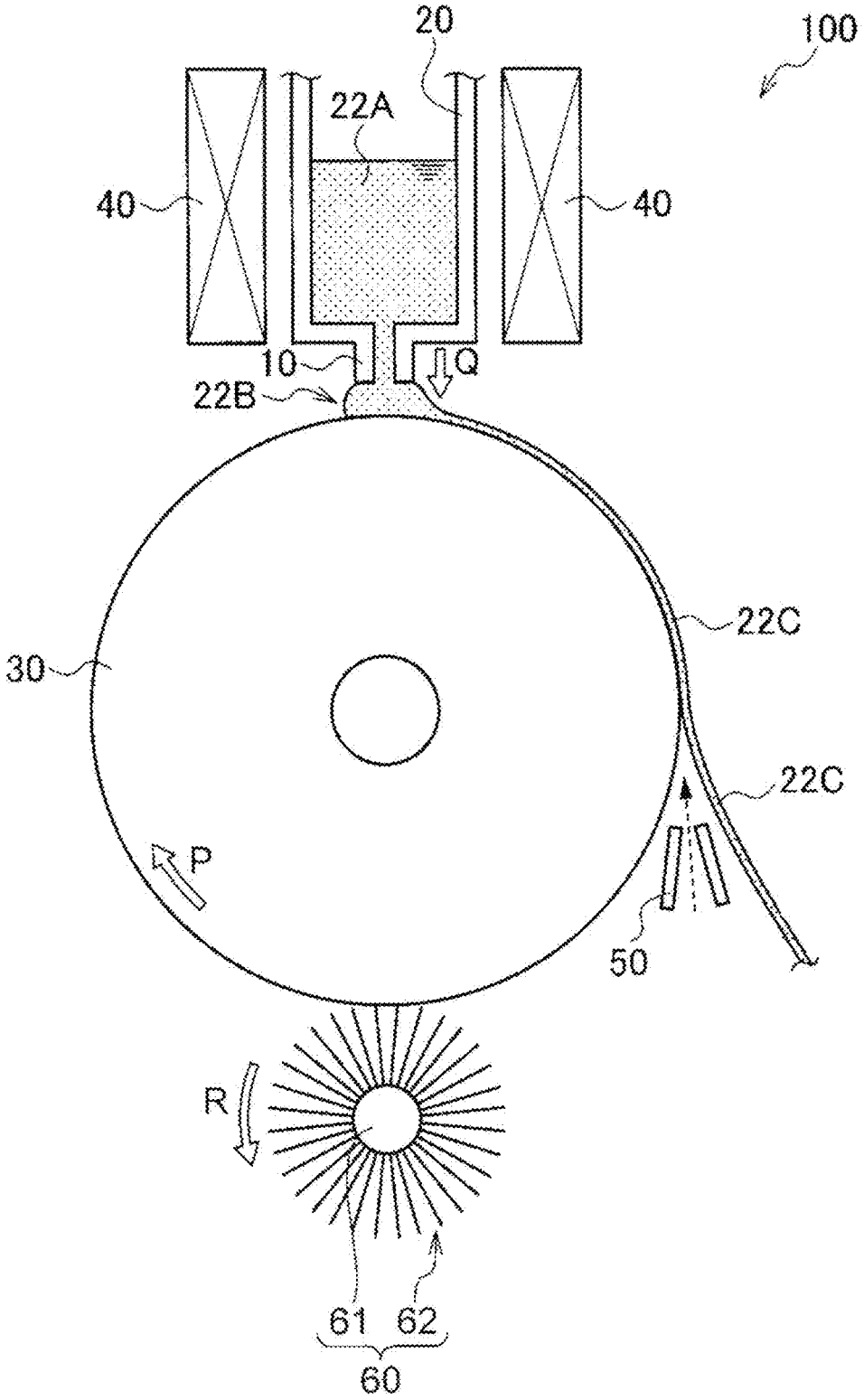
FIG. 1 is a conceptual cross-sectional view schematically showing an example of an Fe-based amorphous alloy ribbon manufacturing device based on a single-roll method, the manufacturing device being suitable for an embodiment of the invention.

Hereinafter, an Fe-based amorphous alloy ribbon for an Fe-based nanocrystalline alloy and a method of manufacturing the same, according to the present disclosure, will be described in detail.

In this specification, a numeral range expressed using "to" means a range including numeral values described in front of and behind "to" as the lower limit value and the upper limit value.

Further, in this specification, the term "process" includes not only an independent process, but also a case which cannot be clearly distinguished from other process, as long as the predetermined purpose of the process is achieved.

In this specification, an Fe-based amorphous alloy ribbon refers to a ribbon (thin strip) made from an Fe-based amorphous alloy.

Furthermore, in this specification, an Fe-based amorphous alloy refers to an amorphous alloy in which the content (atom %) of Fe (iron) is the largest, among the contents of metal elements incorporated therein.

The Fe-based amorphous alloy ribbon for an Fe-based nanocrystalline alloy according to the present disclosure is an Fe-based amorphous alloy ribbon for producing an Fe-based nanocrystalline alloy, by subjecting the Fe-based amorphous alloy ribbon to crystallization. Hereinafter, the "Fe-based amorphous alloy ribbon for an Fe-based nanocrystalline alloy" is also referred to as, simply, "Fe-based amorphous alloy ribbon".

[Fe-Based Amorphous Alloy Ribbon]

The Fe-based amorphous alloy ribbon (hereinafter, may also be referred to as, simply, "alloy ribbon" or "ribbon") according to the present disclosure is a cooled body of a molten metal that has been applied to a surface of a chill roll at the time of production, and has a recess having a depth of 1 μm or more in a 0.647 mm×0.647 mm region located in a central part in the ribbon width direction of a ribbon surface, which is a cooled surface cooled by the chill roll, in which a maximum area of the recess having a depth of 1 μm or more is 3000 $\mu m^2$ or less.

The molten metal of the Fe-based amorphous alloy for an Fe-based nanocrystalline alloy, the molten metal including Fe-Si-B-Cu-Nb in the composition, is easily crystallized and has a nature of exhibiting low wettability with respect to a copper (Cu) alloy used in the chill roll. Therefore, as the molten metal is cooled on the peripheral surface of the chill roll, the molten metal is easily peeled off from the peripheral surface. Then, cooling with respect to the molten metal, that needs to be rapidly solidified on the chill roll, becomes gradually or insufficiently. As a result, an adverse effect such as lowering of magnetic properties or embrittlement of the alloy ribbon to be produced may be caused. This tends to appear remarkably, as a width of the alloy ribbon to be produced (namely, the length in the axial direction of the chill roll) gets greater.

In consideration of the above circumstances, the Fe-based amorphous alloy ribbon according to the embodiment of the invention has low wettability to the chill roll, and is imparted with adhesion such that, even if the alloy ribbon has a form of a wide ribbon, the alloy ribbon is not easily peeled off when subjected to rapid solidification on the chill roll, and thus, the rapid cooling speed at the time of cooling is maintained. Further, a maximum area of recesses having a depth of 1 μm or more and being present in a 0.647 mm×0.647 mm region located in a central part in the ribbon width direction of a ribbon surface, which is a cooled surface, is 3000 $\mu m^2$ or less.

Hereinafter, the Fe-based amorphous alloy ribbon is further explained in detail.

Formation of recesses having a depth of 1 μm or more and a maximum area of 3000 $\mu m^2$ or less can be conducted by appropriately selecting the conditions of the polishing brush roll. By selecting the conditions of the polishing brush roll, not polishing scratches linear in the roll rotational direction but polishing scratches inclined with respect to the roll rotational direction can be formed on the peripheral surface of the chill roll. In the case in which polishing scratches are present in the roll rotational direction, only one or more long narrow recesses (which is referred to as "air pockets"; here, the "air" means "atmospheric gas"; the term "recess" is also referred to as "gas pocket".) can be obtained. Whereas, in the case in which inclined polishing scratches are present, plural recesses (air pockets) which are finely dispersed on the ribbon surface can be obtained. In this way, recesses having a depth of 1 μm or more and a maximum area of 3000 $\mu m^2$ or less can be formed.

Further, by the formation of, not polishing scratches linear in the roll rotational direction but, polishing scratches inclined with respect to the roll rotational direction on the peripheral surface of the chill roll, an anchor effect suitable for preventing peeling can be obtained, when a molten metal is applied onto the roll surface and the molten metal penetrates the polishing scratches and is solidified.

Further, air is taken in between the molten metal and the roll surface. However, since the recesses (air pockets) are present in the state of being finely dispersed, lowering of the cooling speed of the molten metal, which is likely to occur due to the presence of recesses (air pockets), is suppressed.

It is guessed as follows. Namely, in the Fe-based amorphous alloy ribbon according to the present disclosure, by the presence of polishing scratches inclined with respect to the rotational direction of the roll surface, the anchor effect against the stress trying to peel off, which may be generated due to the shrinkage stress in the ribbon width direction, is exhibited owing to the molten metal that has penetrated the polishing scratches before solidification and, as a result, peeling (separation) is suppressed.

Further, by appropriately selecting the conditions of the polishing brush roll, the size and number of the recesses (air pockets) in the cooled surface of the alloy ribbon that has been casted can be considerably reduced, as compared with the case of not properly selecting the conditions of the polishing brush roll. In addition, in the Fe-based amorphous alloy ribbon according to the present disclosure, since the size and number of the recesses (air pockets) in the cooled surface are controlled, enhancement of a space factor in the core, when the ribbon is wound up, can also be expected.

In the present disclosure, among the recesses (air pockets) having a depth of 1 μm or more and being possessed on the ribbon surface, the recesses (air pockets) having a depth of 1 μm or more and being present in a 0.647 mm×0.647 mm region located in a central part in the ribbon width direction are focused, and the maximum area of the recesses, among the recesses (air pockets) having a depth of 1 μm or more and being present in this region, is let be 3000 $\mu m^2$ or less.

Plural recesses (air pockets) may be present on the ribbon surface. It is thought that the cooling speed at the time of cooling of the ribbon is likely to be lowered, mostly in the central part in the ribbon width direction. Therefore, it is required that the maximum area is adjusted to be within the above range, in the recesses (air pockets) that are present in a 0.647 mm×0.647 mm region (hereinafter, also referred to as "specific region") located in the central part in the ribbon width direction.

Here, the central part in the ribbon width direction is a region of a width of 10% of the ribbon width including the center in the ribbon width direction.

The depth of a recess (air pocket) indicates the distance (μm) from the cooled surface that has been in contact with the chill roll, in the thickness direction of the alloy ribbon. Further, the area of a recess (air pocket) indicates an area of a recess (air pocket) in a plane including the cooled surface that has been in contact with the chill roll. In a case in which plural recesses (air pockets) are present, the area of a recess (air pocket) having the largest area in a plane including the cooled surface is designated as the maximum area.

The presence or absence of a recess (air pocket), and a length L, a width W, and a depth of a recess (air pocket), as well as an area of a recess (air pocket) are measured using a high resolution laser microscope OLS4100 (trade name, manufactured by Olympus Corporation).

In order to suppress lowering of the cooling speed at the time of rapid cooling of the molten alloy, the maximum area of the recesses (air pockets) having a depth of 1 μm or more is preferably 2500 $\mu m^2$ or less, and more preferably 2000 $\mu m^2$ or less.

Further, in order to ensure industrial productivity, the maximum area of the recesses (air pockets) having a depth of 1 μm or more is preferably 100 $\mu m^2$ or more.

Among the recesses (air pockets) having a depth of 1 μm or more and being present in the specific region, the area ratio of the total of recesses (air pockets) having an area of 100 $\mu m^2$ or more, in the specific region, is preferably less than 10%, more preferably in a range of 1% or more but less than 8%, still more preferably in a range of 1% or more but less than 5%, and still more preferably in a range of 3% or more but less than 5%.

When the area ratio of the total of recesses (air pockets) having an area of 100 $\mu m^2$ or more is less than 8%, lowering of the cooling speed due to the air (air pocket) that has penetrated the recess is suppressed, and the magnetic properties are likely to be maintained favorable. Further, when the area ratio of the recesses (air pockets) having an area of 100 $\mu m^2$ or more is 1% or more, industrial productivity can be ensured.

The area ratio of the recesses can be determined by measuring the area of all of the recesses, which have a depth of 1 μm or more and are present in the specific region, using an image analysis software SCANDIUM (trade name, manufactured by Olympus Corporation), and calculating the ratio at which the area of the total of all the recesses (those having a depth of 1 μm or more) occupies the area of the specific region.

Among the above, the case in which the maximum area of the recesses (air pockets) having a depth of 1 μm or more and being present in the specific region is 2500 $\mu m^2$ or less, and the area ratio of the recesses (air pockets) having a depth of 1 μm or more and an area of 100 $\mu m^2$ or more, in the specific region, is 1% or more but less than 5% is particularly preferable, in view of ensuring industrial productivity while suppressing lowering of the cooling speed at the time of rapid cooling of the molten alloy.

Regarding the recess (air pocket) having a depth of 1 μm or more, it is preferable that the length L (μm) in the casting direction and the length W (μm) in the ribbon width direction satisfy Equation 1 below. Further, a mode in which, among the recesses (air pockets), 60% or more of the recesses (air pockets) to a total number thereof satisfy Equation 1 is more preferable.

A ratio of the number of the recesses (air pockets) that satisfy Equation 1 to a total number of recesses (air pockets) is more preferably 70% or more, and still more preferably 80% or more.

Note that, the "casting direction" indicates the longitudinal direction of the alloy ribbon that has been produced to have a long length, and the "ribbon width direction" indicates the lateral direction orthogonal to the casting direction.

$$0.6 \leq L/W \leq 1.8 \quad \text{Equation 1}$$

Concerning the shape of the recess (air pocket) as the ribbon is viewed on plane, when the ratio of the length in the casting direction to the length in the ribbon width direction is from 0. 6 to 1.8, by the presence of polishing scratches inclined with respect to the roll rotational direction, enlargement of the area of the recesses (air pockets) formed at the time of casting is suppressed, lowering of the cooling speed is suppressed, and deterioration of magnetic properties is suppressed.

For the same reason as that described above, a mode in which L/W satisfies Equation 2 below is more preferable. Further, a mode in which, among the recesses (air pockets), 30% or more of the recesses (air pockets) with respect to the total number thereof satisfy Equation 2 is more preferable.

A ratio of the number of the recesses (air pockets) that satisfy Equation 2 to the total number of recesses (air pockets) is more preferably 45% or more, and still more preferably 55% or more.

$$0.6 \leq L/W \leq 1.2 \quad \text{Equation 2}$$

In the Fe-based amorphous alloy ribbon according to the present disclosure, a greater ribbon width (a width in the ribbon width direction) is preferable. The ribbon width is more preferably from 70 mm to 300 mm, and still more preferably from 100 mm to 250 mm. In the case of an alloy ribbon having such a wide width, the peeling suppression effect at the chill roll is high, and the magnetic property enhancing effect is further exhibited. Accordingly, the Fe-based amorphous alloy ribbon according to the present disclosure is particularly suitable as a wide alloy ribbon having a width of 70 mm or more.

When the width of the alloy ribbon is 70 mm or more, a practical transformer with a large capacity can be obtained. Meanwhile, when the width of the alloy ribbon is 220 mm or less, the productivity (suitability for production) of the alloy ribbon is excellent.

From the viewpoints of the magnetic properties and productivity (suitability for production) of the alloy ribbon, the width of the alloy ribbon is more preferably from 100 mm to 250 mm, and still more preferably from 140 mm to 220 mm.

The thickness of the alloy ribbon is preferably in a range of from 10 μm to 26 μm.

When the thickness is 10 μm or more, the mechanical strength of the alloy ribbon is ensured, and rapture of the alloy ribbon is suppressed. Accordingly, continuous casting of the alloy ribbon becomes possible. The thickness of the alloy ribbon is preferably 12 μm or more. Further, when the thickness is 26 μm or less, a stable amorphous state can be obtained in the alloy ribbon.

The thickness of the alloy ribbon is more preferably 22 μm or less.

Concerning the composition of the Fe-based amorphous alloy according to the present disclosure, the content (atom %) of Fe (iron) is the largest, among the contents of metal elements incorporated therein. The case in which the Fe-based amorphous alloy has an Fe—Si—B—Cu—Nb series composition is preferable.

The Fe-based amorphous alloy contains at least Fe (iron), but it is preferable to further contain Si (silicon) and B (boron). It is more preferable to further contain copper (Cu) and niobium (Nb), in addition to Fe, Si, and B. The Fe-based amorphous alloy may further contain C (carbon), which is an element incorporated in the source materials for a molten alloy, such as pure iron. Note that, niobium (Nb) can be substituted with molybdenum (Mo) or vanadium (V), and a part of iron (Fe) can be substituted with nickel (Ni) or cobalt (Co).

The Fe-based amorphous alloy may be an Fe-based amorphous alloy in which the content of Fe is from 72 atom % to 84 atom %, the content of Si is from 2 atom % to 20 atom %, the content of B is from 5 atom % to 14 atom %, the content of Cu is from 0.2 atom % to 2 atom %, the content of Nb is from 0.1 atom % to 5 atom %, and the content of C (carbon) is 0.5 atom % or less when the total content of Fe, Si, B, Cu, Nb, C, and inevitable impurities is 100 atom %, with the remainder consisting of impurities.

Figure 4:
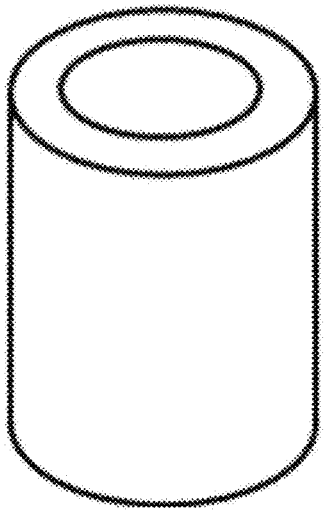
FIG. 4 is a schematic perspective view showing an example of a magnetic core.

When the content of Fe is 72 atom % or more, the saturation magnetic flux density of the alloy ribbon becomes higher, and thus an increase in size or an increase in weight of a magnetic core to be produced by using the alloy ribbon is further suppressed. The shape of the magnetic core to be produced by using the alloy ribbon may be a round shape as shown in FIG. 4, or can be made to be a substantially rectangular shape or a race track-like shape by using a jig (a core material) for molding at the inner side in the diameter direction of the cave portion.

When the content of Fe is 84 atom % or less, a decrease in Curie point of the alloy and a decrease in the crystallization temperature are further suppressed, and thus the stability of magnetic properties of the magnetic core is further enhanced.

Further, when the content of C (carbon) is 0.5 atom % or less, embrittlement of the alloy ribbon is further suppressed.

The content of C (carbon) is preferably from 0.1 atom % to 0.5 atom %. More preferably, the content of C (carbon) is from 0.15 atom % to 0.35 atom %.

When the content of C (carbon) is 0.1 atom % or more, productivity of the molten alloy and productivity of the alloy ribbon are excellent.

More preferable examples of the Fe-based amorphous alloy include:

(a) an Fe-based amorphous alloy in which the content of Si is from 12 atom % to 18 atom %, the content of B is from 5 atom % to 10 atom %, the content of Cu is from 0.8 atom % to 1.2 atom %, the content of Nb is from 2.0 atom % to 4.0 atom %, and the content of C is from 0.1 atom % to 0.5 atom % when the total content of Fe, Si, B, Cu, Nb, C, and inevitable impurities is 100 atom %, with the remainder consisting of Fe and inevitable impurities; and (b) an Fe-based amorphous alloy in which the content of Si is from 14 atom % to 16 atom %, the content of B is from 6 atom % to 9 atom %, the content of Cu is from 0.9 atom % to 1.1 atom %, the content of Nb is from 2.5 atom % to 3.5 atom %, and the content of C is from 0.15 atom % to 0.35 atom % when the total content of Fe, Si, B, Cu, Nb, C, and inevitable impurities is 100 atom %, with the remainder consisting of Fe and inevitable impurities.

In each of the Fe-based amorphous alloys described above, the content of C (carbon) is preferably from 0.1 atom % to 0.5 atom % when the total content of Fe, Si, and B is 100 atom %.

The Fe-based amorphous alloy ribbon for an Fe-based nanocystalline alloy according to the present disclosure can be produced by selecting a known manufacturing method without any particular limitation as far as a ribbon having a prescribed recess (air pocket) in a specific region at a cooled surface, as described above, can be produced by the method. Preferably, the Fe-based amorphous alloy ribbon for an Fe-based nanocystalline alloy according to the present disclosure is produced by the following method of manufacturing an Fe-based amorphous alloy ribbon for an Fe-based nanocystalline alloy.

[Method of Manufacturing Fe-Based Amorphous Alloy Ribbon]

The method of manufacturing an Fe-based amorphous alloy ribbon for an Fe-based nanocrystalline alloy (hereinafter, also referred to as, simply, "the method of manufacturing an Fe-based amorphous alloy ribbon") according to the present disclosure includes a process of applying a molten metal onto a surface of a chill roll, while continuously polishing the chill roll by using a polishing brush roll that satisfies the following conditions (1) to (6).

(1) Composition of the brush bristle of the polishing brush roll: inorganic abrasive grains for polishing/polyamide resin=30% by mass/70% by mass (2) Particle diameter of the inorganic abrasive grain for polishing: from 60 μm to 90 μm (3) Shape of a cross section orthogonal to the longitudinal direction of the brush bristle of the polishing brush roll: a round shape having a diameter of from 0.7 mm to 1.0 mm (4) Speed of the polishing brush roll relative to the speed of the chill roll: from 10 m/sec to 23 m/sec (5) Angle θ made by the rotational direction of the brush bristle tip and the rotational direction of the chill roll: from 5° to 30°

(6) Pressure in applying the molten metal: from 20 kPa to 30 kPa

The method of manufacturing an Fe-base amorphous alloy ribbon according to the present disclosure includes applying a molten metal onto a surface of a chill roll, on which polishing scratches inclined with respect to the roll rotational direction has been formed by using a polishing brush roll that satisfies the above conditions (1) to (6).

First, the polishing brush roll is described.

—Polishing Brush Roll—

As a polishing brush roll, it is preferable to use a polishing brush roll (for example, a polishing brush roll 60 in FIG. 1) including a roll axis member and a polishing brush, which is composed of numerous brush bristles and is placed around the roll axis member.

(Resin)

The brush bristle that constitutes the polishing brush contains a polyamide resin.

When the brush bristle contains a polyamide resin, deep polishing scratches are less likely to occur on the peripheral surface of the chill roll, and it becomes possible to select the polishing scratches to be formed on the peripheral surface of the chill, in accordance with the way to bring into contact with the brush bristles. In this way, it is possible to suppress peeling off (separation) of the alloy ribbon from the chill roll.

Examples of the polyamide resin include nylon resins, such as Nylon 6, Nylon 612, or Nylon 66.

Further, the content of the polyamide resin in the brush bristle (the content of the polyamide resin with respect to the total amount of brush bristle; hereinafter the same applies.) is preferably 50% by mass or more, and more preferably 60% by mass or more. When the content of the polyamide resin in the brush bristle is 50% by mass or more, a phenomenon in which deep polishing scratches occur on the peripheral surface of the chill roll is further suppressed. The upper limit of the content of the resin in the brush bristle may be 100% by mass, but may be 60% by mass, 65% by mass, 75% by mass, or 80% by mass.

(Inorganic Abrasive Grains for Polishing)

The brush bristle contains inorganic abrasive grains for polishing, in addition to the polyamide resin described above.

When the brush bristle contains inorganic abrasive grains for polishing, the polishing ability with respect to the peripheral surface of the chill roll is further improved. Therefore, formation of polishing scratches having a shape suitable for obtaining an anchor effect on the alloy ribbon is performed easily.

Examples of the inorganic abrasive grain for polishing include alumina and silicon carbide.

Regarding the above condition (2), the particle diameter of the inorganic abrasive grain for polishing is preferably from 40 μm to 120 μm, and more preferably from 60 μm to 90 μm.

Here, "the particle diameter of the inorganic abrasive grain for polishing" represents the size of a mesh opening of a sieve, through which the particle of the inorganic abrasive grain for polishing can pass. For instance, "the particle diameter of the inorganic abrasive grain for polishing is from 60 μm to 90 μm" represents that the inorganic abrasive grain for polishing passes through a mesh having an opening of 90 μm but does not pass through a mesh having an opening of 60 μm.

A ratio (mass ratio; inorganic abrasive grains for polishing/polyamide resin) of the content of the inorganic abrasive grains for polishing in the brush bristle relative to the content of the polyamide resin in the brush bristle is preferably from 10% by mass/90% by mass to 40% by mass/60% by mass, more preferably from 25% by mass/75% by mass to 35% by mass/65% by mass, and still more preferably 30% by mass/70% by mass.

When the content of the inorganic abrasive grains for polishing is 40% by mass or less, incorporation of the abrasive grains for polishing into the molten alloy is further suppressed, and defects in the alloy ribbon caused by the abrasive grains for polishing are suppressed. When the content of the inorganic abrasive grains for polishing is 10% by mass or more, control of polishing scratches on the peripheral surface of the chill is performed easily.

Regarding the above conditions (1) and (2), as to the composition of the brush bristle of the polishing brush roll, from the viewpoint that control of the polishing scratches on the peripheral surface of the chill roll is performed easily, the case in which the inorganic abrasive grain for polishing is silicon carbide, the polyamide resin is nylon (preferably, Nylon 612), silicon carbide/nylon=30% by mass/70% by mass, and the particle diameter of the inorganic abrasive grain for polishing is from 60 μm to 90 μm is particularly preferable.

Regarding the above condition (3), the shape of a cross section orthogonal to the longitudinal direction of the brush bristle of the polishing brush roll is a round shape, which includes a completely round shape and oval. Further, the diameter of the round cross section of the brush bristle is from 0.7 mm to 1.2 mm, and is preferably from 0.8 mm to 1.0 mm.

As the condition other than the above conditions (1) to (6), concerning the brush bristles, the density of brush bristles at the tip thereof is preferably from 0.2 bristles/$mm^2$ to 0.45 bristles/$mm^2$, and more preferably from 0.27 bristles/$mm^2$ to 0.40 bristles/$mm^2$.

When the density of brush bristles is 0.2 bristles/$mm^2$ or more, the polishing ability with respect to the peripheral surface of the chill roll is further improved and fine polishing scratches are easily formed on the peripheral surface. Further, when the density of brush bristles is 0.45 bristles/$mm^2$ or less, frictional heat radiation property at the time of polishing is excellent.

As the condition other than the above conditions (1) to (6), the roll diameter of the polishing brush roll is preferably in a range of from 120 mm to 300 mm, more preferably in a range of from 130 mm to 250 mm, and still more preferably in a range of from 140 mm to 200 mm, in diameter.

Note that, the length in the axial direction of the polishing brush roll can be set as appropriate in accordance with the width of the alloy ribbon to be produced.

—Conditions for Polishing Peripheral Surface of Chill Roll by Using Polishing Brush Roll—

Next, the conditions for polishing the peripheral surface of the chill roll is described.

Regarding the above condition (4), the speed of the polishing brush roll relative to the speed of the chill roll is preferably from 10 m/s to 23 m/s.

When the relative speed is 10 m/s or more, the polishing ability with respect to the peripheral surface of the chill roll is further improved and fine ruggedness is easily formed, due to polishing, on the peripheral surface. Further, the relative speed being 23 m/s or less is advantageous in terms of reduction in frictional heat at the time of polishing.

The relative speed is more preferably from 12 m/s to 23 m/s, and still more preferably from 13 m/s to 20 m/s.

Here, in a case in which the rotational direction of the polishing brush roll is opposite to the rotational direction of the chill roll (for example, in the case of FIG. 1), the speed of the polishing brush roll relative to the speed of the chill roll means the absolute value of the difference between the rotation speed (absolute value) of the polishing brush roll and the rotation speed (absolute value) of the chill roll. In this case, at the contact portion where the peripheral surface of the chill roll contacts the brush bristle, a specific point in the peripheral surface of the chill roll and a specific brush bristle of the polishing brush roll move toward the same direction.

Meanwhile, in a case in which the rotational direction of the polishing brush roll and the rotational direction of the chill roll are identical, the speed of the polishing brush roll relative to the speed of the chill roll means the sum of the rotation speed (absolute value) of the polishing brush roll and the rotation speed (absolute value) of the chill roll.

Regarding the above condition (5), the angle θ made by the rotational direction of the tip of the brush bristle of the polishing brush roll and the rotational direction of the chill roll is from 5° to 30°.

Figure 2:
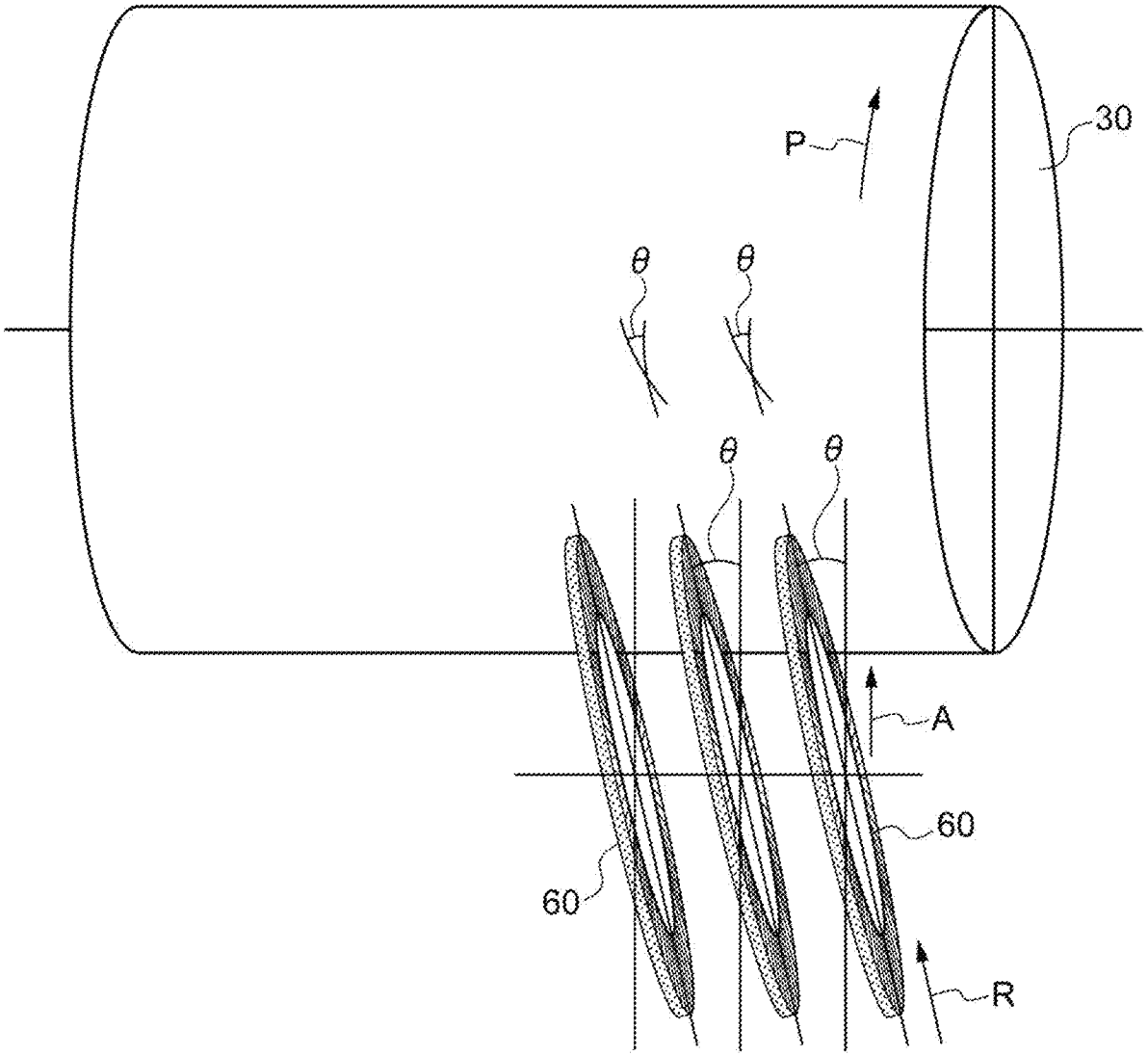
FIG. 2 is a schematic perspective view showing the positional relationship of the polishing brush roll relative to the chill roll.
Figure 3:
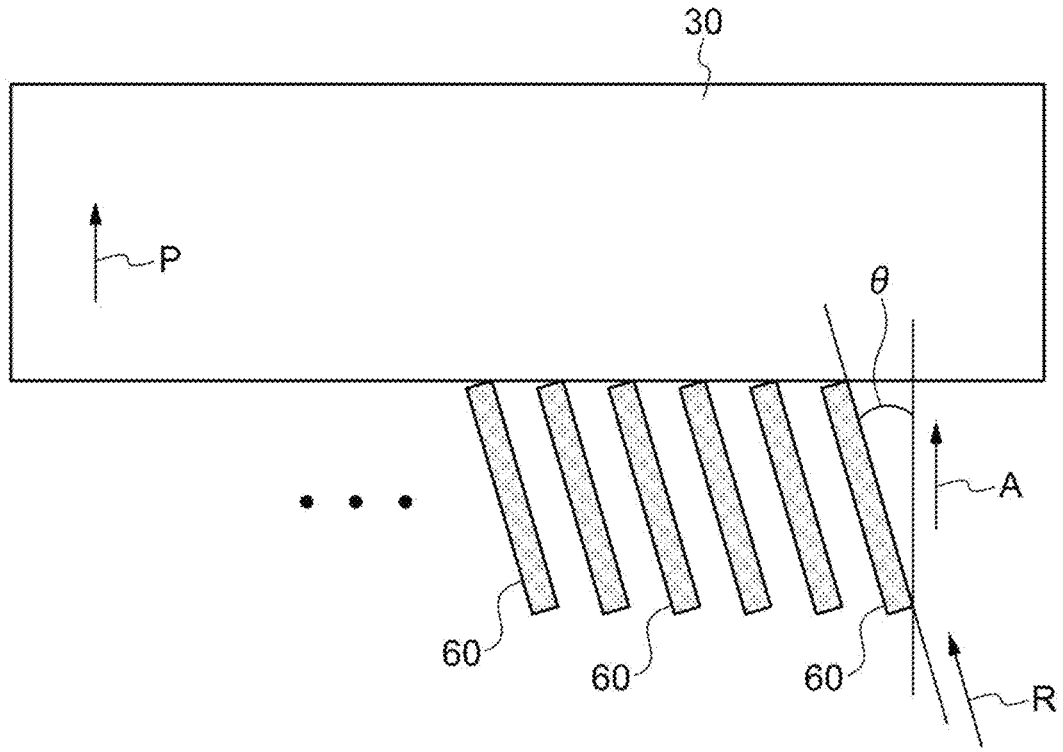
FIG. 3 is a schematic front elevational view showing the positional relationship between the polishing brush roll and the chill roll in FIG. 2.

For example, the chill roll and the polishing brush roll may be arranged as shown in FIG. 2 and FIG. 3. Namely, the chill roll 30 and the polishing brush roll 60 are arranged in a positional relationship that the respective rotational directions make an angle θ. In this case, in the polishing brush roll 60, the rotational direction R of the tip of the brush bristles which are provided along the periphery of the polishing brush roll makes an angle θ with respect to the rotational direction P of the chill roll 30, and the angle θ is controlled to be within a range of from 5° to 30°.

Here, the rotational direction R of the brush bristle tip indicates the surface direction of a plane including the round main face of the polishing brush roll having a disc shape, as shown in FIG. 3, for example.

By providing an angle θ, not linear polishing scratches along the roll rotational direction P, but polishing scratches inclined with respect to the roll rotational direction P can be formed on the peripheral surface of the chill roll. By the formation of inclined polishing scratches, when the molten metal is applied and is rapidly solidified, to prepare an alloy ribbon, plural recesses (air pockets) which are finely dispersed on the ribbon surface can be formed. That is, when the angle θ is 5° or more, plural recesses (air pockets) dispersed on the ribbon surface are uniformly formed without being concentrated. Further, when the angle θ is 30° or less, formation of polishing scratches over the entire region in the rotation axial direction (alloy ribbon width) of the peripheral surface of the chill roll becomes easier, which is thus advantageous.

The angle (the angle θ in FIG. 2 and FIG. 3) made by the rotational direction R of the tip of the brush bristle of the polishing brush roll and the rotational direction of the chill roll is preferably from 10° to 25°, and more preferably from 12° to 20°.

Conventionally, the rotational direction (the direction represented by the arrow A in FIG. 3) of the polishing brush roll is ordinary parallel to the rotational direction P of the chill roll. However, as in the embodiment of the invention, in the case in which the rotational direction of the polishing brush roll is made to be inclined at an angle θ from the direction represented by the arrow A, which is parallel to the rotational direction P of the chill roll, in the state in which the tip of the brush bristle does not contact the surface of the chill roll, the movement of the tip of the brush bristle is identical with the rotational direction of the brush roll; however, in the state in which the chill roll and the brush bristle tip are in contact with each other, polishing scratches inclined with respect to the rotational direction P at an angle centered around the angle θ made by the rotational direction R of the brush bristle tip and the rotational direction P of the chill roll are formed on the surface of the chill roll, by using the brush bristles.

Further, in the method of manufacturing an Fe-based amorphous alloy ribbon according to the present disclosure, the vertical direction (a constant direction with respect to time) at an arbitrary position on the peripheral surface of the chill roll, on which an alloy ribbon is to be casted, and the longitudinal direction of brush bristle having a substantially linear shape are neither identical, nor parallel, the vertical direction and the longitudinal direction of the brush bristle make an angle (an angle within the range of from 5° to 30°), and this angle can be periodically changed with time. In more detail, when viewed from the chill roll, according to the rotation speed of the polishing brush roll, the rotational direction of the polishing brush roll can be changed by inclination, periodically, within the range of an angle of ±θ.

Note that, it is allowed that there is a case in which the vertical direction and the longitudinal direction of the brush bristle temporally become identical or parallel, since the angle periodically changes with time.

The depth of the polishing scratches formed on the surface of the chill roll is preferably in a range of from 1 μm to 2 μm.

The push-in amount of the brush bristle (polishing brush) with respect to the peripheral surface of the chill roll is adjusted as appropriate. The push-in amount can be set to be, for example, from 1 mm to 10 mm.

Regarding the above condition (6), the pressure in applying the molten metal (discharge pressure of the molten metal) is in a range of from 20 kPa to 30 kPa, preferably from 23 kPa to 28 kPa, and more preferably from 25 kPa to 28 kPa.

When the discharge pressure of the molten metal is 20 pKa or more, the formation of a recess (air pocket) is suppressed, and cooling can be conducted more efficiently. As a result, a coarse crystalline grain is less likely to generate in the alloy system, and a favorable magnetic property ($B_{800}$) can be obtained. Further, when the discharge pressure of the molten metal is 30 kPa or less, the shape of the puddle (molten metal puddle) is stable, and there is attained an advantage that stable casting becomes possible.

The distance between the tip of the molten metal nozzle and the peripheral surface of the chill roll is preferably from 0.1 mm to 0.4 mm, and more preferably from 0.1 mm to 0.3 mm.

The method of manufacturing an Fe-based amorphous alloy ribbon according to the present disclosure is further explained by referring to the drawings.

FIG. 1 is a conceptual cross-sectional view schematically showing an example of an Fe-based amorphous alloy ribbon manufacturing device based on a single-roll method, and shows a cross section of the alloy ribbon manufacturing device sectioned by a plane perpendicular to the axial direction of the chill roll 30 and to the width direction of the alloy ribbon. Here, the alloy ribbon 22C is an example of the Fe-based amorphous alloy ribbon according to the embodiment of the invention. Further, the axial direction of the chill roll 30 and the width direction of the alloy ribbon 22C are identical.

As shown in FIG. 1, an alloy ribbon manufacturing device 100, which is an Fe-based amorphous alloy ribbon manufacturing device, is provided with a crucible 20 provided with a molten metal nozzle 10, and a chill roll 30 whose peripheral surface faces a tip of the molten metal nozzle 10.

The crucible 20 has an internal space that can accommodate a molten alloy 22A, which is a source material for an alloy ribbon 22C, and the internal space is communicated with a molten metal flow channel in a molten metal nozzle 10. As a result, a molten alloy 22A accommodated in the crucible 20 can be discharged through the molten metal nozzle 10 to a chill roll 30 (in FIG. 1, the discharge direction and the flow direction of the molten alloy 22A is represented by the arrow Q). A crucible 20 and a molten metal nozzle 10 may be configured as an integrated body or as separate bodies.

At least partly around a crucible 20, a high-frequency coil 40 is placed as a heating means. By this, a crucible 20 in a state accommodating a mother alloy of an alloy ribbon can be heated to form a molten alloy 22A in the crucible 20, or a molten alloy 22A supplied from the outside to the crucible 20 can be kept in a liquid state.

Further, the molten metal nozzle 10 has an opening (a discharge port) for discharging a molten alloy toward the direction represented by the arrow Q.

It is appropriate that this opening is a rectangular (slit shape) opening.

The distance (the closest distance) between the tip of the molten metal nozzle 10 and the peripheral surface of the chill roll 30 is so small that, when the molten alloy 22A is discharged through the molten metal nozzle 10, a puddle 22B (a molten metal puddle) is formed.

The chill roll 30 rotates axially in the direction of the rotational direction P.

A cooling medium such as water is circulated inside the chill roll 30, with which the coated film of a molten alloy formed on the peripheral surface of the chill roll 30 can be cooled. By cooling the coated film of the molten alloy, an alloy ribbon 22C (an Fe-based amorphous alloy ribbon) is formed.

Examples of the material of the chill roll 30 include Cu and Cu alloys (a Cu—Be alloy, a Cu—Cr alloy, a Cu—Zr alloy, a Cu—Cr—Zr alloy, a Cu—Ni alloy, a Cu—Ni—Si alloy, a Cu—Ni—Si—Cr alloy, a Cu—Zn alloy, a Cu—Sn alloy, a Cu—Ti alloy, and the like). From the viewpoint of having a high thermal conductivity, a Cu alloy is preferable, and a Cu—Be alloy, a Cu—Cr—Zr alloy, a Cu—Ni alloy, a Cu—Ni—Si alloy, or a Cu—Ni—Si—Cr alloy is more preferable.

Although there is no particular limitation as to the surface roughness of the peripheral surface of the chill roll 30, the arithmetic average roughness (Ra) of the peripheral surface of the chill roll 30 is preferably from 0.1 μm to 0.5 μm, and more preferably from 0.1 μm to 0.3 μm. When the arithmetic average roughness Ra of the peripheral surface of the chill roll 30 is 0.5 μm or less, the space factor in the production of a transformer using the alloy ribbon is further enhanced. When the arithmetic average roughness Ra of the peripheral surface of the chill roll 30 is 0.1 μm or more, adjustment of Ra becomes easier.

The arithmetic average roughness Ra means a surface roughness measured according to JIS B 0601:2013.

From the viewpoint of cooling ability, the diameter of the chill roll 30 is preferably from 200 mm to 1000 mm, and more preferably from 300 mm to 800 mm.

The rotation speed of the chill roll 30 may be in a range ordinary set for a single-roll method. A circumferential speed of from 10 m/s to 40 m/s is preferable, and a circumferential speed of from 20 m/s to 30 m/s is more preferable.

The alloy ribbon production apparatus 100 is further equipped with a peeling gas nozzle 50, as a peeling means for peeling off the Fe-based amorphous alloy ribbon from the peripheral surface of the chill roll, at a downstream side of the molten metal nozzle 10 in the rotational direction of the chill roll 30 (hereinafter, also referred to simply as "the downstream side").

In this example, by blowing a peeling gas through the peeling gas nozzle 50 in the direction (the direction of a dashed line arrow in FIG. 1) opposite to the rotational direction P of the chill roll 30, peeling of the alloy ribbon 22C from the chill roll 30 is performed. As the peeling gas, for example, a nitrogen gas or a high pressure gas such as compressed air can be used.

The alloy ribbon production apparatus 100 is further equipped with a polishing brush roll 60 as a polishing means for polishing the peripheral surface of the chill roll 30, at a downstream side of the peeling gas nozzle 50.

The polishing brush roll 60 includes a roll axis member 61 and a polishing brush 62 placed around the roll axis member 61. The polishing brush 62 is composed of numerous brush bristles.

By axially rotating the polishing brush roll 60 in the rotational direction R, the peripheral surface of the chill roll 30 is polished by using the brush bristles of the polishing brush 62.

The purpose of polishing by using the above polishing means (for example, polishing brush roll 60) is not necessarily limited to scrubbing the peripheral surface of the chill roll, and the purpose may include removing residues remained on the peripheral surface of the chill roll. It is preferable that the purpose of the above polishing is at least one of the following first purpose or the second purpose.

The first purpose is to repair the deterioration in smoothness of the peripheral surface of the chill roll. In detail, when a molten alloy and a peripheral surface of a chill roll contact each other for the first time, there are cases in which a very small portion of the peripheral surface of the chill roll (for example, a Cu alloy) dissolves in the molten alloy and a micro recessed part (an omitted portion) is formed on the peripheral surface of the chill roll to deteriorate the smoothness of the peripheral surface of the chill roll. Deterioration in smoothness of the peripheral surface of the chill roll may cause deterioration in smoothness of the roll surface (the surface that has been in contact with the peripheral surface of the chill roll; hereinafter in the present specification, the same applies.) of the alloy ribbon to be produced. Also in a case in which the smoothness of the peripheral surface of the chill roll has been deteriorated, by the above polishing, a relatively projected part (namely, a part where the dissolution has been suppressed) relative to the above micro recessed part (an omitted portion) is removed in roughly equal measure, so that the deterioration in smoothness of the peripheral surface of the chill roll can be repaired. As a result, deterioration in smoothness of the roll surface of the alloy ribbon, which is caused by the deterioration in smoothness of the peripheral surface of the chill, can be suppressed.

The second purpose is to remove the residue (alloy) remained on the peripheral surface of the chill roll after peeling of an alloy ribbon. The molten alloy that has been discharged onto the peripheral surface of the chill roll is rapidly cooled to form an alloy ribbon, and thereafter, the alloy ribbon is peeled off from the peripheral surface of the chill roll. In this process, there are cases in which a portion of the alloy, which is the material of the alloy ribbon, does not peel off from the peripheral surface of the chill roll and remains as a residue, and this residue is fixed to the peripheral surface of the chill roll to form a projected part. Since casting of the alloy ribbon is performed continuously, the molten alloy is discharged again onto the peripheral surface of the chill roll, the peripheral surface having a projected part of the above residue formed thereon. As a result, in the roll surface of the alloy ribbon to be produced, there are cases in which a recessed part is formed at the position corresponding to the above projected part, to deteriorate smoothness of the roll surface of the alloy ribbon. Further, in a case in which the thermal conductivity of the residue (alloy) that forms the projected part is lower than the thermal conductivity of the peripheral surface (for example, a Cu alloy) of the chill roll, characteristics of rapid cooling by the chill roll is partially deteriorated in the above projected part, and there is concern that magnetic properties of the alloy ribbon may be deteriorated. Also in a case in which the residue remains on the peripheral surface of the chill roll after peeling of the alloy ribbon, the residue can be removed by the above polishing. As a result, deterioration in smoothness of the roll surface of the alloy ribbon, which is caused by the above residue, can be suppressed. Further, deterioration in magnetic properties of the alloy ribbon, which is caused by the above residue, can be suppressed.

Further, in this example, as shown in FIG. 1, the rotational direction R of the polishing brush roll is opposite to the rotational direction P of the chill roll (in FIG. 1, the rotational direction R is counterclockwise, and the rotational direction P is clockwise). Here, the chill roll and the polishing brush roll are arranged to have a positional relationship shown in FIG. 2 and FIG. 3. In a case in which the rotational direction of the chill roll and the rotational direction of the polishing brush roll are viewed from the front face of the device, the rotational direction R of the polishing brush roll and the rotational direction P of the chill roll have an angle θ (=from 5° to 10°).

In a case in which the rotational direction of the polishing brush roll is opposite to the rotational direction of the chill roll, a specific point in the peripheral surface of the chill roll and a specific brush bristle of the polishing brush roll move toward the same direction at the contact portion of the chill roll and the polishing brush roll.

In the embodiment of the invention, unlike the above example, the rotational direction of the polishing brush roll and the rotational direction of the chill roll may be identical. In a case in which the rotational direction of the polishing brush roll and the rotational direction of the chill roll are identical, a specific point in the peripheral surface of the chill roll and a specific brush bristle of the polishing brush roll move toward the opposite direction from each other at the contact portion of the chill roll and the polishing brush roll.

The alloy ribbon production apparatus 100 may be provided with other element (for example, a wind-up roll for reeling up the produced alloy ribbon 22C, a gas nozzle for blowing a $CO_2$ gas, an $N_2$ gas, or the like to the puddle 22B of a molten alloy or its vicinity, or the like) in addition to the elements described above.

Further, the basic configuration of the alloy ribbon production apparatus 100 may be similar to a configuration of an amorphous alloy ribbon production apparatus based on a conventional single-roll method (see, for example, International Publication WO 2012/102379, Japanese Patent No. 3494371, Japanese Patent No. 3594123, Japanese Patent No. 4244123, Japanese Patent No. 4529106, or the like).

Next, an example of a production method of the alloy ribbon 22C using the alloy ribbon production apparatus 100 will be described.

First, a molten alloy 22A as a source material for the alloy ribbon 22C is prepared in the crucible 20. The temperature of the molten alloy 22A is set as appropriate considering the composition of the alloy, and is, for example, from 1210° C. to 1410° C. and preferably from 1280° C. to 1400° C.

Next, the molten alloy is discharged through the molten metal nozzle 10 onto the peripheral surface of the chill roll 30, which rotates axially in the rotational direction P, and while forming a puddle 22B, a coated film of the molten alloy is formed. The coated film thus formed is cooled on the peripheral surface of the chill roll 30, to form an alloy ribbon 22C on the peripheral surface. Then, the alloy ribbon 22C formed on the peripheral surface of the chill roll 30 is peeled off from the peripheral surface of the chill roll 30 by blowing a peeling gas from the peeling gas nozzle 50 and reeled up on a wind-up roll (not shown in the figure) in a form of a roll for recovery.

Meanwhile, after the alloy ribbon 22C has been peeled off, the peripheral surface of the chill roll 30 is polished by using the polishing brush 62 of the polishing brush roll 60, which rotates axially in the rotational direction R. The molten alloy is discharged again onto the peripheral surface of the chill roll 30 that has been subjected to polishing.

The operations described above are carried out repeatedly and thus, a long alloy ribbon 22C is produced (casted) continuously.

By the manufacturing method according to the example described above, an alloy ribbon 22C, which is an example of the Fe-based amorphous alloy ribbon according to the embodiment of the invention, is produced. The thickness of the alloy ribbon 22C is from 10 μm to 26 μm.

Hereinafter, a preferable scope of one example of the manufacturing method is explained.

EXAMPLES

Hereinafter, the present invention is further described in detail with reference to Examples; however, the invention is by no means limited to the following Examples unless they are beyond the spirit of the invention. Unless otherwise specifically stated, "part" is based on mass.

Examples 1 to 5

<Preparation of Fe-Based Amorphous Alloy Ribbon>

An alloy ribbon manufacturing device having a configuration similar to that of the alloy ribbon manufacturing device 100 shown in FIG. 1 was prepared.

As the chill roll, a chill roll having a diameter of 400 mm, in which the material of the peripheral surface is a Cu—Ni alloy and an arithmetic average roughness Ra of the peripheral surface is 0.3 μm, was used. The polishing brush roll is described below.

First, a molten alloy consisting of Fe, Si, B, Cu, Nb, C, and inevitable impurities (hereinafter also referred to as an "Fe—Si—B—Cu—Nb series molten alloy") was prepared in a crucible. Specifically, pure iron, ferrosilicon, and ferroboron were mixed and melted, to prepare a molten alloy in which the content of Si is 15 atom %, the content of B is 7 atom %, the content of Cu is 1 atom %, the content of Nb is 3 atom %, and the content of C is 0.2 atom % when the total content of Fe, Si, B, Cu, Nb, C, and inevitable impurities is 100 atom %, with the remainder consisting of Fe and inevitable impurities.

These numerical values of atom % are the amounts obtained by extracting a portion of the alloy from the molten metal and performing measurement according to ICP (inductively coupled plasma) optical emission spectrophotometry.

Next, this Fe—Si—B—Cu—Nb series molten alloy was discharged from a molten metal nozzle having a rectangular (slit shape) opening with a long side length of 142 mm and a short side length of 0.5 mm, through the opening onto the peripheral surface of the rotating chill roll for rapid solidification, to produce (cast) 3000 kg of an amorphous alloy ribbon having a ribbon width of 142 mm and a thickness of 18 μm. The casting time was 80 minutes and the alloy ribbon was casted continuously without any breakage. Note that, in all of the Examples, an alloy ribbon was casted continuously without any breakage.

The above casting was performed while polishing the peripheral surface of the chill roll by using a polishing brush (brush bristles) of a polishing brush roll. Polishing was performed by bringing the polishing brush of the polishing brush roll into contact with the peripheral surface of the chill roll. In this process, the polishing brush roll was arranged so that the rotational direction P of the chill roll was inclined at an angle θ with respect to the rotational direction R of the polishing brush roll, as shown in FIG. 2 and FIG. 3. The molten alloy was discharged onto the peripheral surface of the chill roll that had been polished, to produce an Fe-based amorphous alloy ribbon having a width of 142 mm (see FIG. 1).

Detailed conditions for the casting are shown below.

—Conditions for Casting—

Temperature of the molten alloy: 1300° C.

Circumferential speed of the chill roll: 25 m/s

Discharge pressure of the molten alloy: adjusted within the range of from 20 kPa to 30 kPa Distance (gap) between the molten metal nozzle tip and the peripheral surface of the chill roll: adjusted within the range of from 0.15 mm to 0.35 mm —Polishing Brush Roll and Conditions for Polishing—

(1) a composition of the brush bristle contains Nylon 612 (70% by mass) as the resin, and silicon carbide (30% by mass) as the inorganic abrasive grains for polishing;

(2) a particle diameter of silicon carbide in the brush bristle (polishing brush) is in a range of from 60 μm to 90 μm;

(3) a shape of a cross section orthogonal to a longitudinal direction of the brush bristle is a round shape having a diameter of 0.8 mm;

(4) a rotation speed of the polishing brush roll relative to a rotation speed of the chill roll is adjusted within a range of from 11 m/sec to 23 m/sec;

(5) an angle θ formed by a rotational direction of a tip of the brush bristle and a rotational direction of the chill roll is 15°, in which relationship between the rotational direction of the polishing brush roll and the rotational direction of the chill roll is opposite direction (at a contact portion, a specific point in a peripheral surface of the chill roll and a brush bristle move toward the same direction);

(6) a roll diameter (diameter) of the polishing brush roll is 150 mm, a length in the axial direction of the polishing brush roll is 300 mm; and (7) a density of brush bristles at the brush bristle tip is 0.27 bristles/mm$^2$.

In the above, in Examples 2 to 5, an Fe-based amorphous alloy ribbon having a width length of 142 mm was prepared in a manner similar to that in Example 1, except that, compared to Example 1, the discharge pressure of the molten metal was changed as shown in Table 1 below.

Comparative Example 1

An Fe-based amorphous alloy ribbon having a width length of 142 mm was prepared in a manner similar to that in Example 1, except that, in Example 1, the discharge pressure of the molten metal was changed as shown in Table 1 below.

Comparative Example 2

An Fe-based amorphous alloy ribbon having a width length of 142 mm was prepared in a manner similar to that in Example 1, except that, in Example 1, the discharge pressure of the molten metal was changed as shown in Table 1 below.

Comparative Example 3

An Fe-based amorphous alloy ribbon having a width length of 142 mm was prepared in a manner similar to that in Example 1, except that, in Example 1, the angle θ made by the rotational direction of the brush bristle tip and the rotational direction of the chill roll was changed to 0° from 15°.

Comparative Example 4

An Fe-based amorphous alloy ribbon having a width length of 142 mm was prepared in a manner similar to that in Example 1, except that, in Example 4, the angle θ made by the rotational direction of the brush bristle tip and the rotational direction of the chill roll was changed to 0° from 15°.

<Measurement of Recess (Air Pocket)>

The alloy ribbon that had been rapidly solidified on the chill roll was wound, to prepare an Fe-based amorphous alloy ribbon. The recesses (air pockets) that are present in a 0.647 mm×0.647 mm region located in a central part in the ribbon width direction of a cooled surface (contact face with the chill roll) of the Fe-based amorphous alloy ribbon thus prepared were measured using a high resolution laser microscope OLS4100 (trade name, manufactured by Olympus Corporation). As a result of the measurement, it was confirmed that all the Fe-based amorphous alloy ribbons have one or more recesses (air pockets) having a depth of 1 μm or more. Further, the length L, the width length W, and the depth of recesses (air pockets), the maximum area of the recesses (air pockets) having a depth of 1 μm or more and, the area ratio were determined.

Figure 5:
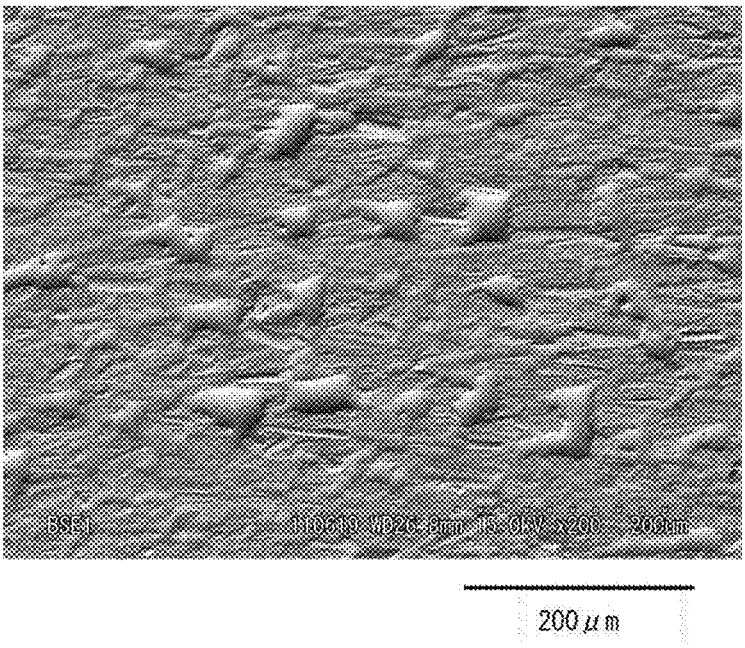
FIG. 5 is an SEM photo showing the surface of the Fe-based amorphous alloy ribbon of Example 1.
Figure 6:
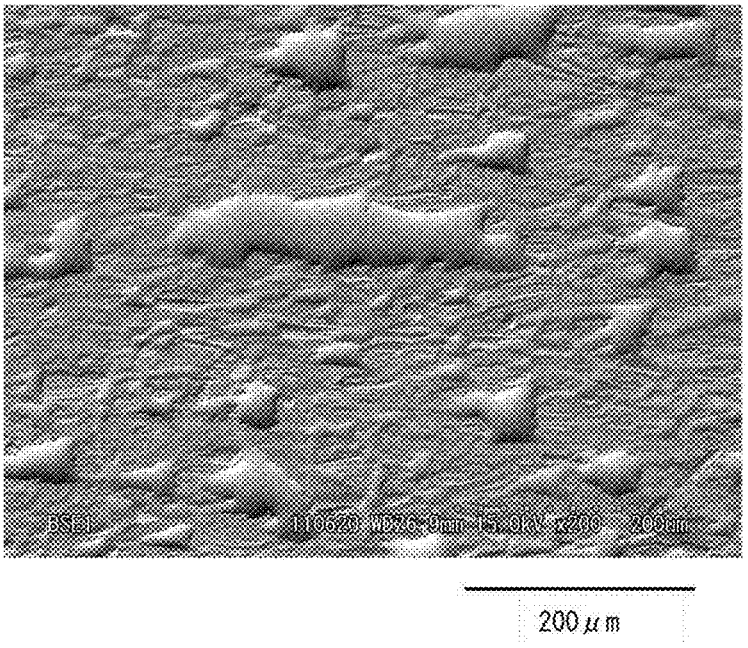
FIG. 6 is an SEM photo showing the surface of the Fe-based amorphous alloy ribbon of Comparative Example 1.

A scanning electron microscope (SEM) photo of the alloy ribbon of Example 1 is shown in FIG. 5, and an SEM photo of the alloy ribbon of Comparative Example 1 is shown in FIG. 6.

<Preparation of Magnetic Core>

The Fe-based amorphous alloy ribbon having a width of 142 mm, which had been prepared as described above, was cut (slit) into ribbons having a width of 33 mm, except for the both end portions of 5 mm in the width direction. Then, a 4-fold ribbon in which the resulting 4 sheets are disposed one on another was prepared. Thereafter, as shown in FIG. 4, the alloy ribbon was wound up to form a size having an outer diameter of 19 mm and an inner diameter of 15 mm, thereby obtaining a toroidal shaped wound body. In the outermost peripheral part, at a position that falls about 1 mm to about 2 mm from the outermost peripheral ribbon end, one or two points placed in the width direction were fixed by spot welding. The wound body thus obtained was subjected to the following heat treatment for nanocrystallization, to prepare a magnetic core.

The heat treatment was performed as follows. Namely, in a nitrogen atmosphere, the temperature was elevated from room temperature (for example, 20° C.) to 550° C. in 4 hours, and was kept at 550° C. for 20 minutes, and then was lowered to 100° C. or lower in 2 hours.

<Measurement of Magnetic Flux Density>

The magnetic core which had been prepared as described above was stored in a storage box made of plastic, and then an insulation coated conducting wire having a diameter of 0.5 mm was wound on the outside of the storage box, 10 turns in a primary coil and 10 turns in a secondary coil. Using a direct current magnetization measuring instrument SK110 (trade name, manufactured by METRON, Inc.), the magnetic flux density $B_{800}$ (T) at a magnetic field intensity of 800 A/m was determined. The results are shown in Table 1 below.

TABLE 1

| | Brush Bristle Angle θ [°] | Discharge Pressure of molten metal [kPa] | Maximum area of Recesses [μm²] | Area Ratio of Recesses Depth ≥ 1 μm, Area ≥ 100 μm² | Area Ratio of Recesses Depth ≥ 1 μm, Area: 100-2500 μm² | Ratio of Recesses 0.6 ≤ L/W ≤ 1.8 | Ratio of Recesses 0.6 ≤ L/W ≤ 1.2 | Magnetic Flux Desity $B_{800}$ (T) |
|---|---|---|---|---|---|---|---|---|
| Example 1 | 15 | 25.5 | 1565 | 3.4% | 3.4% | 85% | 58% | 1.19 |
| Example 2 | 15 | 24.5 | 2041 | 3.7% | 3.7% | 86% | 36% | 1.18 |
| Example 3 | 15 | 22.5 | 2409 | 4.8% | 3.5% | 71% | 57% | 1.19 |
| Example 4 | 15 | 24.0 | 2322 | 3.3% | 3.3% | 94% | 61% | 1.18 |
| Example 5 | 15 | 27.5 | 1543 | 1.9% | 1.9% | 82% | 55% | 1.20 |
| Comparative Example 1 | 15 | 18.0 | 8636 | 12.4% | 5.1% | 53% | 27% | 1.14 |
| Comparative Example 2 | 15 | 19.0 | 7288 | 11.5% | 7.4% | 54% | 23% | 1.16 |
| Comparative Example 3 | 0 | 25.5 | 4543 | 10.1% | 2.9% | 56% | 17% | 1.15 |
| Comparative Example 4 | 0 | 24.0 | 4617 | 11.2% | 2.5% | 39% | 17% | 1.15 |

As shown in Table 1, in Examples 1 to 5, $B_{800}$ is 1.18 T or more, which is an excellent value. Although the alloy ribbon is a wide alloy ribbon, lowering of $B_{800}$ is not recognized. From this result, it is guessed that, in the state in which cooling is insufficient at the surface of the chill roll, peeling or separation is suppressed; and, after the molten metal of the alloy ribbon has been discharged onto the chill roll and solidified, and after cooled sufficiently, peeling of the ribbon is done. Namely, it is guessed that, since the cooling speed is sufficient, the alloy ribbon that has been casted on the chill roll is a stable amorphous (noncrystalline) substance.

In Examples 1 to 5, although the alloy ribbon is a wide alloy ribbon having a width length of 70 mm or more, a magnetic flux density $B_{800}$ comparable to that of a magnetic core prepared using a conventionally used, narrow ribbon having a width length of from 50 mm to 60 mm was obtained.

Further, in the alloy ribbon of Comparative Example 1, as shown in FIG. 6, a state in which long narrow recesses (referred to as air pockets) are formed on the surface is seen, whereas in FIG. 5 which shows the surface of the alloy ribbon of Example 1, it is understood that plural recesses (air pockets), which are dispersed on the surface, are formed.

It is thought that the recess (air pocket) includes air or an atmospheric gas that is drawn into the interface when the molten alloy contacts the chill roll. In general, when the recess (air pocket) is large, or the number of recesses is large, since air or a gas has a low thermal conductivity, there is a tendency that cooling of the molten alloy on the chill roll becomes insufficient.

In Examples, since the area of the recess is small and the area ratio is small, the magnetic property $B_{800}$ is excellent.

In contrast, in Comparative Examples, the value of $B_{800}$ is low. It is guessed that, in Comparative Examples, cooling of the recess (air pocket) part is insufficient, and a coarse crystalline grain is generated partly in the alloy system, and therefore the magnetic property $B_{800}$ is deteriorated. In this point, Comparative Examples are different from Examples in which the alloy ribbon that has been casted on the chill roll is a stable amorphous (noncrystalline) substance.

Note that, the deterioration of magnetic property due to the coarse crystalline grain cannot be improved by the heat treatment for nanocrystallization.

The disclosure of U.S. Provisional Patent Application No. 62/479,330 filed Mar. 31, 2017 is incorporated by reference herein in its entirety.

All publications, patent applications, and technical standards mentioned in this specification are herein incorporated by reference to the same extent as if such individual publication, patent application, or technical standard was specifically and individually indicated to be incorporated by reference.

What is claimed is:

1. An Fe-based amorphous alloy ribbon for an Fe-based nanocrystalline alloy, and wherein the Fe-based amorphous alloy ribbon is a cooled body of a molten metal that has been applied to a surface of a chill roll, wherein:

the Fe-based amorphous alloy ribbon comprises a plurality of air pockets having a depth of 1 μm or more in a 0.647 mm × 0.647 mm region located in a central part, in a ribbon width direction, of a ribbon surface, wherein the surface of the chill roll has polishing scratches inclined with respect to a rotational direction of the chill roll, the plurality of air pockets are recesses on a surface of the Fe-based amorphous alloy ribbon that are formed by cooling a molten alloy using the chill roll having the inclined polishing scratches, the ribbon surface is a cooled surface, the plurality of air pockets are finely dispersed, and the central part in the ribbon width direction is a region of a width of 10% of the ribbon width including the center in the ribbon width direction, each air pocket has an area of 3000 $\mu m^2$ or less, and wherein 70% to 94% of the plurality of air pockets with respect to a total number thereof satisfy Equation 1:

$$0.6 \leq L/W \leq 1.8 \quad \text{Equation 1}$$

wherein, L represents a length of the air pockets in a casting direction, and W represents a width of the air pocket in the ribbon width direction, which is orthogonal to the casting direction.

2. The Fe-based amorphous alloy ribbon according to claim 1, wherein an area ratio of a plurality of air pockets having an area of 100 $\mu m^2$ or more, in the region, is at least 1% or more and less than 10%.

3. The Fe-based amorphous alloy ribbon according to claim 2, wherein the area ratio is at least 1% and less than 5%.

4. The Fe-based amorphous alloy ribbon according to claim 2, wherein each air pocket has an area of 2500 $\mu m^2$ or less.

5. The Fe-based amorphous alloy ribbon according to claim 4, wherein the ribbon has a width of 70 mm to 250 mm.

6. The Fe-based amorphous alloy ribbon according to claim 2, wherein the ribbon has a width of 70 mm to 250 mm.

7. The Fe-based amorphous alloy ribbon according to claim 1, wherein each air pocket has an area of 2500 $\mu m^2$ or less.

8. The Fe-based amorphous alloy ribbon according to claim 7, wherein the ribbon has a width of 70 mm to 250 mm.

9. The Fe-based amorphous alloy ribbon according to claim 1, wherein 80%-94% of the plurality of air pockets with respect to a total number thereof satisfy Equation 1.

10. The Fe-based amorphous alloy ribbon according to claim 9, wherein 30% or more of the plurality of air pockets with respect to the total number thereof satisfy Equation 2:

$$0.6 \leq L/W \leq 1.2 \quad \text{Equation 2.}$$

11. The Fe-based amorphous alloy ribbon according to claim 10, wherein each air pocket has an area of 2500 $\mu m^2$ or less.

12. The Fe-based amorphous alloy ribbon according to claim 9, wherein each air pocket has an area of 2500 $\mu m^2$ or less.

13. The Fe-based amorphous alloy ribbon according to claim 12, wherein the ribbon has a width of 70 mm to 250 mm.

14. The Fe-based amorphous alloy ribbon according to claim 1, wherein the ribbon has a width of 70 mm to 250 mm.

15. The Fe-based amorphous alloy ribbon according to claim 1, wherein the Fe-based amorphous alloy ribbon has a composition that includes Fe—Si—B—Cu—Nb.

* * * * *